United States Patent [19]

Bashark

[11] 3,945,217

[45] Mar. 23, 1976

[54] REFRIGERATION SYSTEM DEFROST CONTROL

[75] Inventor: Larry T. Bashark, St. Joseph, Mich.

[73] Assignee: Whirlpool Corporation, Benton Harbor, Mich.

[22] Filed: Apr. 4, 1974

[21] Appl. No.: 457,759

[52] U.S. Cl. ..... 62/151; 62/176; 73/336.5; 338/35

[51] Int. Cl.[2] ..... F25D 21/08

[58] Field of Search ..... 236/44 C, 44 F, 18 B; 62/176, 151, 141; 338/35; 73/336.5; 219/501, 330; 34/46

[56] References Cited

UNITED STATES PATENTS

| | | | |
|---|---|---|---|
| 2,424,735 | 7/1947 | Boothroyd | 62/176 X |
| 2,806,991 | 9/1957 | White | 338/34 |
| 2,820,304 | 1/1958 | Horecky | 236/44 E |
| 2,976,188 | 3/1961 | Kohl | 338/35 X |
| 3,029,610 | 4/1962 | Armentrout | 62/156 |
| 3,465,534 | 5/1969 | Sutton, Jr. et al. | 62/151 |
| 3,679,872 | 7/1972 | Lauck | 219/501 |

*Primary Examiner*—William E. Wayner
*Attorney, Agent, or Firm*—Wegner, Stellman, McCord, Wiles & Wood

[57] ABSTRACT

A refrigeration system having an improved defrost control including a thermal relay, a bimetal thermostat, and a thick film/hybrid microelectronic element responsive to cumulative humidity of the refrigerated air comprising a moisture sensor/cumulator portion and a control circuit portion on a ceramic substrate. The sensor/cumulator absorbs water vapor at a rate proportional to the relative humidity of the refrigerated air and activates a heater element of the thermal relay to initiate a defrost period. The element is reset by thermally removing a preselected amount of the absorbed water vapor. The defrost period is terminated by a bimetal thermostat. Alternatively, a thermal responsive resistor may be included in the control circuit to terminate the defrost period.

40 Claims, 6 Drawing Figures

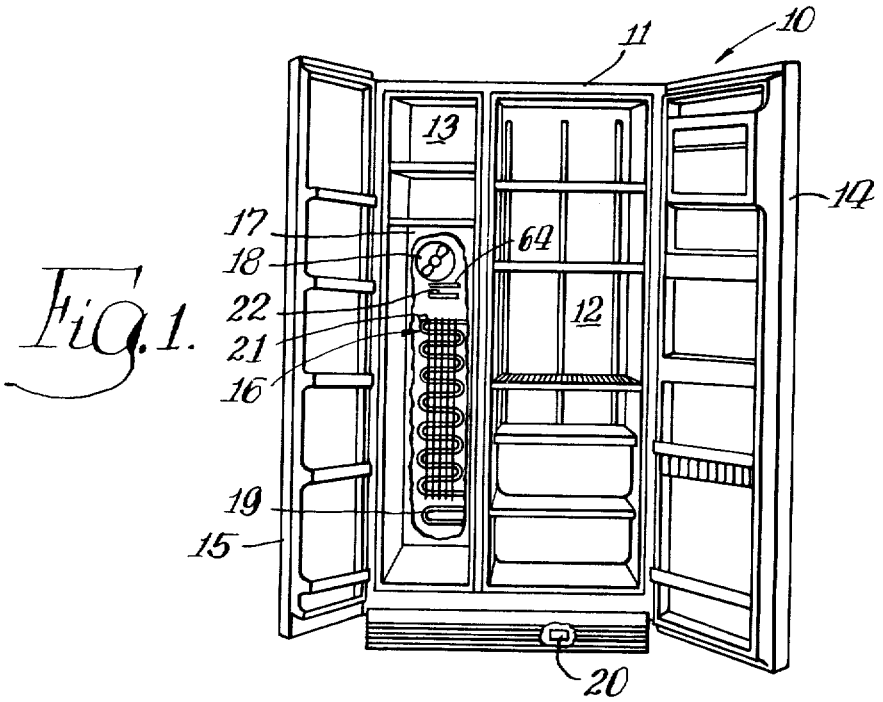
Fig. 1.
Fig. 2.
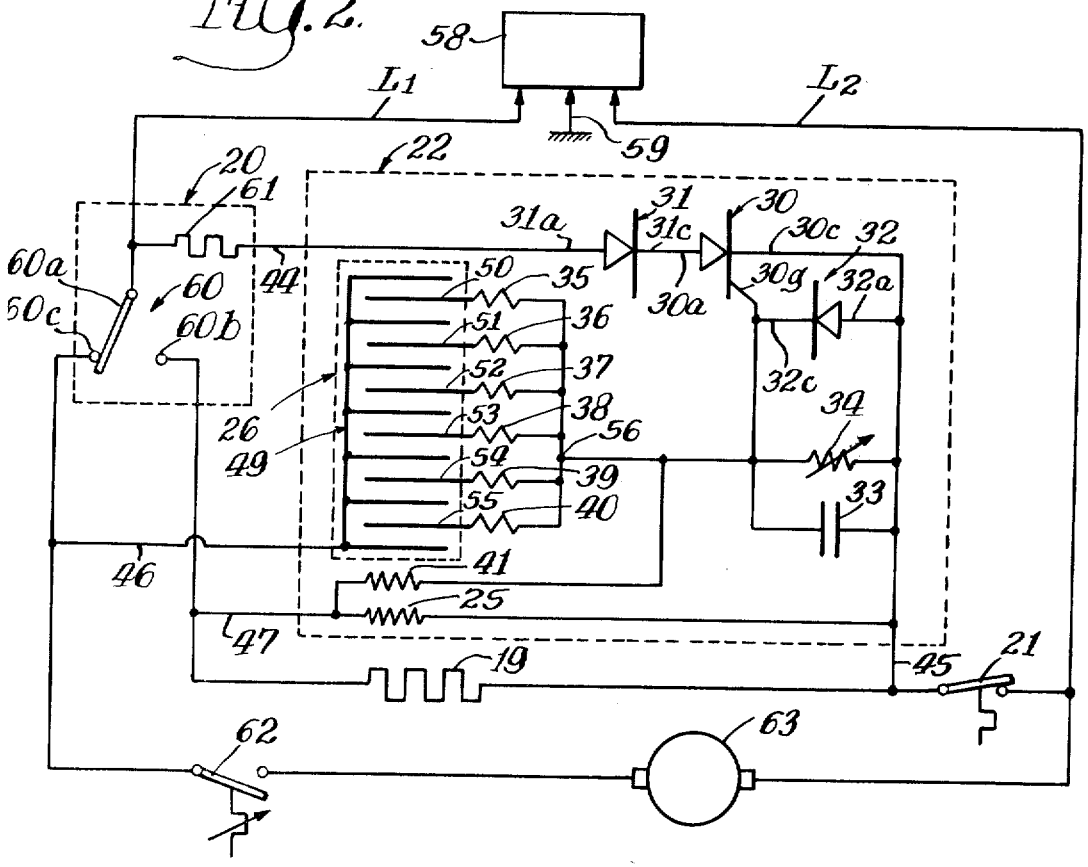

REFRIGERATION SYSTEM DEFROST CONTROL

BACKGROUND OF THE INVENTION

1. Field of the Invention

This invention relates to refrigeration apparatus, and in particular, to means for automatically controlling defrosting of such apparatus.

2. Description of the Prior Art

United States Letters Patent pertinent to the present invention include:

| | | |
|---|---|---|
| 2,229,612 | Pearce | Refrigerating Apparatus |
| 2,295,570 | Dunmore | Humidity Variable Resistance |
| 2,424,735 | Boothroyd | Humidity Control Apparatus |
| 2,444,030 | Burch | Humidity and Temperature Responsive Device |
| 2,510,018 | Gillingham | Electrolytic Humidostat |
| 2,927,524 | Gregor | Polyelectrolyte Water Indicating Devices |
| 3,029,610 | Armentrout | Refrigerating Apparatus Including Defrosting Means |
| 3,120,108 | Pansing | Refrigerating Apparatus Including Defrost Control |
| 3,335,576 | Phillips | Defrost Control for Refrigeration Apparatus |
| 3,460,352 | Lorenz | Defrost Control |
| 3,474,638 | Dodge III | Electronic Refrigeration System Defrost Control |
| 3,622,523 | Amin | Air Fireable Compositions Containing Vanadium Oxide and Boron, and Devices Therefrom |

It is conventional to provide means for automatically defrosting refrigeration systems utilizing evaporator-type cooling means, such as in refrigerators, freezers, and the like. One means for controlling the defrosting operation therein has been a clock-type control which has the disadvantage of requiring the setting thereof for worst case climate and usage conditions so that often too many defrost periods of too long a duration result causing unnecessary power consumption and food thermal cycling. Such clock controls have been found to require substantial maintenance and create a potential noise problem.

Other prior art demand defrost controls have proven to be unreliable and costly. One such control utilizes a hygrometer for sensing the humidity condition of the refrigerated air and an E-Cell coulometer for integrating the humidity information. Such coulometers permit resetting the stored charge thereof for recycling the control during the defrost operation. The electrical circuitry of such controls is relatively complex and costly.

Another prior art control utilizes a photoelectric means for detecting the presence of frost. Such controls have been found to require substantial maintenance. Further, light energy from the lamp tends to heat and distort the formation of frost in the area being monitored.

Another prior art control utilizes one or more thermistor type thermal responsive devices to sense the presence of frost at specific points in the evaporator. It has been found, however, that sensing frost at a given point is unreliable as frost may form irregularly on the evaporator.

Thermal responsive devices have been utilized in connection with defrosting means for controlling termination of the defrost operation. Typically, a bimetal thermostat may be mounted in thermal transfer association to the evaporator and wired in series with the defrost heater to open the heater circuit when the evaporator reaches a high temperature. A clock has been conventionally provided therewith for timing a remainder portion of the defrost period. This remaining period, known as the run-off period, allows melted frost to drain away. One disadvantage of the above system is that the run-off period normally must be longer than that necessary to complete an optimum draining operation. However, the above system has the safety advantage that both the clock and the bimetal thermostat must fail before the refrigeration system would be subjected to unduly high temperatures.

SUMMARY OF THE INVENTION

The present invention comprehends an improved demand defrost control for controlling the operation of a defrosting means in a refrigeration system eliminating the disadvantages of the prior art defrost controls in a novel and simple manner.

More specifically, the present invention comprehends providing such a control means including means for absorbing atmospheric moisture from the refrigerated air and defining a moisture responsive electrical resistance inversely proportional to the amount of absorbed moisture, and control means responsive to the resistance reaching a preselected low value to initiate operation of the defrosting means.

The control means illustratively comprises a thermal relay, a bimetal thermostat, and a thick film/hybrid microelectronic element having a moisture sensor/-cumulator portion for absorbing atmospheric moisture and a control circuit portion carried on a common substrate, illustratively comprising a ceramic substrate.

The moisture absorbing means illustratively comprises a filter which consists of one or more bodies, such as pellets, beads, sheets, etc., of desiccant material with an outer interface exposed to the refrigerator atmosphere and an inner interface in close moisture transfer association with a moisture responsive resistance element provided with thick film interdigital electrodes which is located in an otherwise enclosed air space. The filter means may be pervious for improved moisture transfer.

Illustratively, the desiccant material may be formed of polycrystalline synthetic zeolite having extremely small pore size.

The thick film interdigital conductor electrodes of the moisture responsive resistor may be coated with a hygroscopic film providing electrical conductivity when moist.

The moisture absorbing means may advantageously be disposed in the ambient air adjacent the cooling means of the refrigeration system. Illustratively, where the refrigeration system comprises a refrigerator having an evaporator cooling means, the moisture absorbing means may be disposed adjacent the evaporator. Where the refrigeration system utilizes air moving means for circulating refrigerating air therethrough, the moisture absorbing means may be disposed in the path of the flowed air, and preferably at or near the coldest spot in the refrigeration system for improved sensing of the moisture condition.

The thermal relay may be located outside of the refrigerated space remote from the sensor. Alternatively, the thermal relay contacts and heater may be an integral part of the thick film control element.

More specifically, the control circuit means may comprise a thermal relay with a heater element and a single pole double throw, or a double pole single throw switch element capable of activating the defrosting means, and a solid state sensitive gate silicon controlled rectifier or triac component capable of activating the thermal relay heater element and having a gate triggering circuit responsive to the moisture responsive resistor. A thick film heater resistor may be located on the same thick film substrate as the moisture responsive resistor and desiccant filter means to provide means for thermally regenerating the sensor/cumulator means each defrost cycle by driving off absorbed moisture. In the illustrated embodiment, the regeneration operation is effected concurrently with the defrost operation.

The invention comprehends providing a plurality of components on a single ceramic thick film substrate spaced to achieve optimal functioning of the control. Illustratively, a short thermal path is provided between the thick film regeneration heater and the thick film moisture responsive resistance and desiccant filter. A long thermal path is provided between the regeneration heater and the silicon controlled rectifier to avoid overheating of the rectifier. Connector leads to and from the thick film element may be attached to the substrate near the silicon controlled rectifier to function as a heat sink for cooling the silicon controlled rectifier. A negative temperature coefficient resistor may be included in the gate trigger circuit of the silicon controlled rectifier and arranged to have a long thermal path to the regeneration and defrost heater.

Means are provided to preclude damage to the moisture absorbing means such as by impingement of drops or similar larger quantities of water on the desiccant filter. Baffle means may be provided for adjusting the flow of air to the sensor and for preventing such impingement.

The present invention is simple and economical of construction while yet providing the highly desirable features discussed above.

BRIEF DESCRIPTION OF THE DRAWING

Other features and advantages of the invention will be apparent from the following description taken in connection with the accompanying drawing wherein:

FIG. 1 is a front elevation of a refrigerator-freezer provided with a defrost control embodying the invention;

FIG. 2 is a schematic wiring diagram of the control circuitry thereof;

DESCRIPTION OF THE PREFERRED EMBODIMENT

Figure 3:
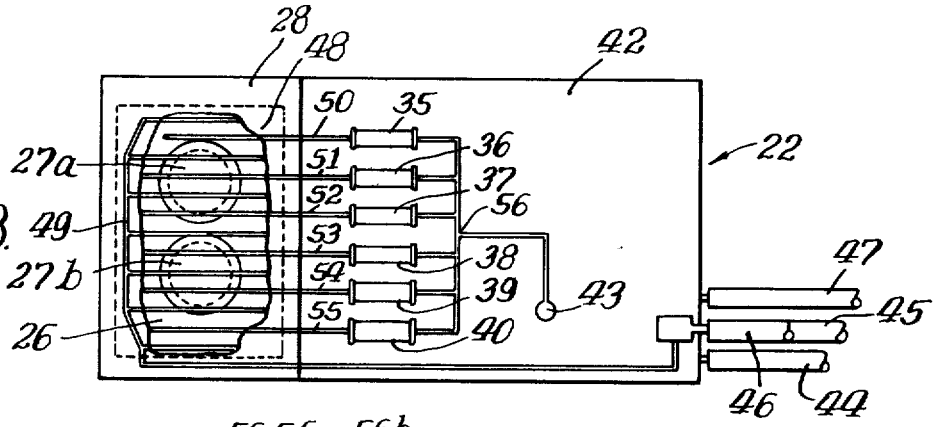
FIG. 3 is a top plan view of a thick film/hybrid microelectronic element thereof.

In the exemplary embodiment of the invention as disclosed in the drawing, a refrigeration system is illustratively shown to comprise a refrigerator-freezer apparatus 10 including a cabinet 11 defining an above-freezing temperature portion 12 and a below-freezing portion 13. Suitable doors 14 and 15 are provided for providing controlled access to the respective refrigeration apparatus portions. Refrigeration of the chambers may be effected by a conventional cooling means, such as evaporator 16, which may be mounted behind the rear liner 17 of the freezer chamber 13 in the conventional manner. Means for circulating the air in heat transfer association with the evaporator and to the respective chambers 12 and 13 may be provided in the form of a conventional fan 18.

The evaporator is defrosted from time to time by means of an electric wire heater defrosting element 19. The present invention comprehends an improved means for controlling the defrosting operation which comprises a thermal relay 20, a bimetal thermostat 21, and a thick film/hybrid microelectronic circuit element 22. Thermal relay 20 may be located behind a removable front grill beneath cabinet 11 for ease of servicing. As shown, the bimetal thermostat 21 is disposed in heat transfer association with evaporator 16.

The thick film element 22 may advantageously be mounted at the coldest portion of the air stream adjacent the evaporator 16. Thick film element 22 comprises a moisture sensor/cumulator portion 23 and a control circuit portion 24. The moisture sensor/cumulator portion 23 may comprise a thick film regeneration heater resistor 25, a moisture responsive resistance element 26, a desiccant filter 27, and a plastic shroud 28 which holds the desiccant filter 27 and defines an enclosed air space 29. The control circuit portion 24 of thick film element 22 may consist of a sensitive gate silicon controlled rectifier 30, two silicon diodes 31 and 32, a capacitor 33, a vanadium oxide negative temperature coefficient thick film resistor 34, thick film current limiting resistors 35, 36, 37, 38, 39 and 40, and a thick film circuit resistor 41. The silicon controlled rectifier 30, diodes 31 and 32, and capacitor 33 are microelectronic components which may be attached to element 22 by reflowing solder.

The control components on element 22 are illustratively interconnected by thick film silver-palladium conductor patterns screened and fired on the top and bottom sides of an alumina substrate 42 with a single feedthrough interconnection from top to bottom which may be through a hole in the substrate 42 at point 43. Illustratively, substrate 42 may be approximately 35 mils thick 1 inch wide and 2 inches long. Four copper lead wires 44, 45, 46, and 47 for providing electrical connection between element 22 and other portions of the refrigeration system are attached to thick film silver-palladium solder pads which surround the silicon controlled rectifier 30 and perform the additional heat sink function of conducting and diverting heat away from the silicon controlled rectifier 30.

The moisture responsive resistance element 26 consists of a thick film, gold interdigital conductor grid which is coated with a hygroscopic film or emulsion 48. On one side of the gold interdigital grid, the conductors 49 are shorted together while the conductors 50, 51, 52, 53, 54 and 55 on the other side of the grid are connected in series with thick film resistors 35, 36, 37, 38, 39 and 40, respectively, to insure that no one portion of the film 48 is conducting an excessive current in the event that one portion of the film 48 becomes moist before the remainder of the film. Resistors 35, 36, 37, 38, 39 and 40 are connected together at point 56 and collectively limit the conductivity of the film 48 to a safe low value.

The hygroscopic film 48 may be formed by placing a drop of water solution of lithium chloride and sodium silicate on the grid, spreading the drop evenly over the entire interdigital grid surface, and allowing the film to dry for two hours in a low humidity environment. The solution may be formulated by stirring 4 grams of lithium chloride and 6 grams of sodium silicate in 150 cc of water. The lithium chloride salt is hygroscopic, thereby attracting and holding water vapor which may be in air space 29 and accounts for most of the electrical conductivity of the film 48 when the film is moist. The sodium silicate which may advantageously have a 2.00 weight ratio of silicon dioxide to sodium oxide, functions as a binder agent to prevent the hygroscopic salt from creeping or agglomerating when moist. The solution may also include small quantities of special purpose additives. Illustratively, glycerin may be added as a water soluble plasticizer to prevent cracking or crazing of the coating; boric acid may be added to prevent discoloration of the coating; and/or a nonionic detergent, such as Triton X-100, may be added to prevent electrical polarization. Polyvinyl acetate may be used as the binding agent instead of sodium silicate, thereby forming a hygroscopic emulsion.

The desiccant filter 27 may advantageously consist of two circular disc-shaped pellets 27*a* and 27*b* with the outer surfaces 56*a* and 56*b* of each pellet exposed to the refrigerated air flow and the inner surfaces 57*a* and 57*b* of each pellet in close moisture transfer association with the enclosed air space 29 and the hygroscopic film 48. An example of such preform filter pellets 27*a* and 27*b* is that marketed under the trademark "Natrasorb" by Multiform Desiccant Products, Inc., consisting essentially of Molecular Sieve desiccant with a 3 Angstrom pore size and an inorganic clay binder. Such a 3A Molecular Sieve desiccant is marketed by the Linde Division of the Union Carbide Corporation in powder and bead form and consists generically of a polycrystalline metal aluminosilicate synthetic zeolite with potassium cations. In the preferred embodiment, the desiccant filter 27 consists of pellets 27*a* and 27*b* with no macropores or air channels which might alter moisture transfer through the pellets from the outer surface, refrigerated air side 56 to the inner surface, hygroscopic film side 57. However, the desiccant may be formulated or processed into bead or other forms which do contain macropores or air channels for improved moisture transfer. Additional desiccant pellets may be attached to the plastic shroud 28 within the air space 29 to provide additional surface for absorption of water vapor to decrease the rate of moisture absorption by the hygroscopic film 48.

The shape of the shroud 28 and desiccant filter 27 may be modified to provide a shorter thermal path between the desiccant filter 27 and the regeneration heater 25. Alternatively, the shroud may be formulated of desiccant and binder.

In all cases, however, the moisture absorbing means comprises a filter 27 which consists of powdered desiccant or one or more bodies (such as pellets, beads, sheets, etc.) of desiccant material with an outer surface or interface 56 exposed to the refrigerator atmosphere and an inner surface of interface 57 in moisture transfer association with a moisture responsive resistance element 26.

Operation of the improved automatic defrost control of the present invention is best understood with reference to the schematic wiring diagram of control 22 shown in FIG. 2. Power to the control is provided from a conventional alternating current power supply 58 which may be provided with a ground 59. Power supply leads L1 and L2 may comprise the incoming power supply to the refrigerator-freezer. Lead L1 is connected to the moving contact 60*a* of a single pole, double throw switch 60 of thermal relay 20 also having a resistance heater 61 connected to power supply lead L1. Illustratively, relay 20 may comprise a Klixon model 60000 single pole, double throw thermal relay with a positive temperature coefficient thermistor heater element 61. One normally closed fixed contact 60*c* of switch 60 is connected through the freezer thermostate 62 and compressor motor 63 to power supply lead L2. The other normally open fixed contact 60*b* of switch 60 is connected through the evaporator defrost heater 19 and the evaporator bimetal thermostat switch 21 to power supply lead L2.

The thermal relay heater 61 is connected to the anode 31a of diode 31 on thick element 22 by lead wire 44. The cathode 31*c* of diode 31 is connected to the anode 30*a* of silicon controlled rectifier 30. The cathode 30*c* of silicon controlled rectifier 30 is connected to a common terminal connecting the evaporator defrost heater 19 and the evaporator bimetal thermostat switch 21 by lead wire 45.

The common side 49 of the moisture responsive resistance element 26 is connected to the normally closed fixed contact 60*c* of switch 60 by lead wire 46. Interdigital conductor fingers 50, 51, 52, 53, 54, and 55 of moisture responsive resistor element 26 are connected in series with thick film resistors 35, 36, 37, 38, 39 and 40, respectively. Resistors 35, 36, 37, 38, 39 and 40 are connected in common at point 56 and connected to the gate 30*g* of silicon controlled rectifier 30. A thick film vanadium oxide resistor 34 is connected from the gate 30*g* to the cathode 30*c* of silicon controlled rectifier 30. Capacitor 33 and diode 32 are connected in parallel with resistor 34 and the anode 32*a* of diode 32 is connected to the cathode 30*c* of silicon controlled rectifier 30. Cathode 32*c* of diode 32 is connected to the gate 30*g* of silicon controlled rectifier 30. The thick film regeneration heater resistor 25 is connected from cathode 30*c* of silicon controlled rectifier 30 to lead wire 47 which is connected to the normally open contact 60*b* of thermal relay switch 60. Circuit resistor 41 is connected from lead wire 47 to the gate 30*g* of silicon controlled rectifier 30.

Figure 4:
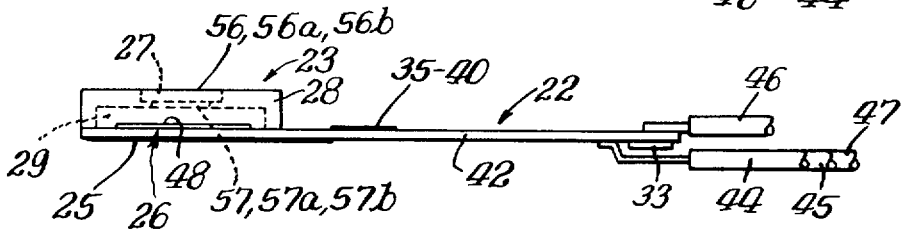
FIG. 4 is a side elevation thereof.
Figure 5:
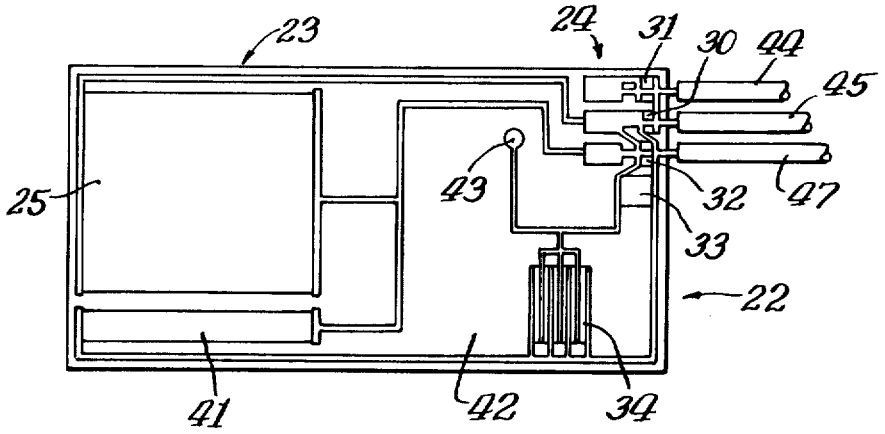
FIG. 5 is a bottom plan view thereof.

The positional relationships between components on alumina substrate 42 may best be understood by reference to FIGS. 3, 4 and 5. Thick film regeneration heater resistor 25 and thick film circuit resistor 41 are both located on the bottom side of substrate 42 directly beneath the moisture responsive resistance element 26 and desiccant filter pellets 27*a* and 27*b* such that resistors 25 and 41 are in close heat transfer association with the moisture sensor/cumulator portion 23 of thick film element 22. The negative temperature coefficient resistor 34, however, is spaced away from resistors 25 and 41 to effect a longer heat transfer path therebetween. The silicon controlled rectifier 30 is preferably spaced as far away from resistors 25 and 41 on substrate 42 as is practical and rectifier 30 is surrounded by copper lead wires 44, 45, 46 and 47 to provide maximum thermal isolation of rectifier 30 from heater resistors 25 and 41.

Diode 31 has a large peak inverse voltage rating and protects the silicon controlled rectifier 30 from negative voltage transients which may occasionally emanate from the alternating current power supply 58. While positive voltage transients may also occasionally emanate from power supply 58 and cause the silicon controlled rectifier 30 to conduct current to the thermal relay heater element 61 for a half cycle, such a short application of power to element 61 does not have detrimental effect on the desired operation of switch 60.

Capacitor 33 prevents radio frequency voltage which may be present on the L1 and L2 power supply leads from falsely triggering the silicon controlled rectifier 30. Capacitor 33 may be approximately 0.01 microfarad.

Diode 32 clamps the gate (30*g*) to cathode (30*c*) voltage of silicon controlled rectifier 30 to a safe low value on negative voltage half cycles, thereby further protecting the silicon controlled rectifier.

Thick film current limiting resistors 35, 36, 37, 38, 39 and 40 may each be approximately 300k ohm resistors. Illustratively, the 13 interdigital gold fingers of the moisture responsive resistance element 26 may be 10 mils wide with a 40 mil spacing. Heater and circuit resistors 25 and 41 may be 5.7k ohm and 68k ohm resistors, respectively, to provide a regeneration temperature of approximately 250°F. at the hygroscopic film 48.

When the refrigerator-freezer 10 is installed, the moisture sensitive resistor 26 may be in a low resistance, moist condition due to normal moisture absorption of the inactive sensor/cumulator 23. Similarly, the bimetal switch contact 21 may be in the open, high temperature position. A defrost period cannot be initiated when bimetal contact 21 is in the open position because of the absence of a current path to energize the thermal relay heater element 61. Hence, when the refrigerator-freezer 10 is installed, the compressor 63 may run for some time without initiating a defrost cycle.

However, when a low temperature is reached causing bimetal contact 21 to close and moving arm 60*a* of switch 60 is making contact with the normally closed contact 60*c*, voltage is now made available to power the moisture responsive resistance element 26 and trigger the gate 30*g* of the silicon controlled rectifier 30. On positive voltage half cycles (i.e., L1 is positive with respect to L2) and with resistor 26 moist, sufficient current will be available to trigger the gate 30*g* of silicon controlled rectifier 30, thereby energizing the thermal relay heater element 61. The thermal regeneration heater resistor 25 and circuit resistor 41 are not energized at this time because contact 60*b* of switch 60 is not connected to L1.

After approximately two minutes of continuous energization of the thermal relay heater 61 on positive voltage half cycles, the moving arm 60*a* snaps from contact 60*c* to contact 60*b* thereby de-energizing the compressor motor 63 and the moisture responsive resistor 26 and energizing the evaporator heater 19, the thick film regeneration heater 25, and the thick film circuit resistor 41. With resistor 26 de-energized, resistor 41 now provides sufficient current to trigger the gate 30*g* of silicon controlled rectifier 30, thereby continuing to energize the thermal relay heater element 61 during the defrosting operation.

During the next several minutes, the sensor/cumulator portion 23 of thick film element 22 is thermally regenerated both by heat from thick film resistors 25 and 41 and to a lesser extent by heat from the main evaporator heater 19. During the thermal regeneration process, the temperature of the hygroscopic film 48 reaches a high temperature, such as approximately 250°F., to drive most of the absorbed moisture out of the hygroscopic film 48, into the enclosed air space 29, and back through the desiccant filter 27, thereby drying the film 48 and to a lesser extent drying the desiccant filter 27. Thus, the moisture absorbing means of the sensor/cumulator 23 is substantially dried, or thermally regenerated, while the evaporator heater 19 is in the process of heating the evaporator 16 and the bimetal thermostat 21. This action continues until the evaporator 16 temperature is sufficiently high as to cause the bimetal contact 21 to open.

When bimetal contact 21 opens, electrical energy is no longer applied to the main evaporator heater 19, the thermal regeneration heater 25, the circuit resistor 41, and the thermal relay heater element 61 so that the thermal relay begins to cool. After approximately 2 minutes, moving arm 60a of thermal relay switch 60 snaps back to make connection with the normally closed switch contact 60*c*, re-energizing the compressor motor 63. The moisture responsive resistance element 26 is not reenergized at this time because bimetal contact 21 is still open. Resistor 26 is re-energized several minutes later, however, when the evaporator 16 temperature has dropped sufficiently to cool the bimetal thermostat 21 and causes the bimetal contacts 21 to close.

Closure of bimetal contact 21 re-energizes the moisture responsive resistance element 26. At this time, however, resistor 26 is in a dry, multimegohm high resistance state and the resistance thereof is too high to provide sufficient current to the gate 30*g* of silicon controlled rectifier 30 to disturb the high resistance, blocking state of rectifier 30. Hence, the next defrost period will not be triggered until sufficient moisture has been reabsorbed by the moisture responsive resistance element 26 as a result of moisture transfer through the desiccant filter 27 from the refrigerated air stream. This may require from several hours to a number of days depending upon all of the factors which may affect the relative humidity of the refrigerated air inside the refrigerator-freezer, such as the number and duration of refrigerator and freezer door openings, icemaker ice consumption, freezer thermostat temperature setting, external ambient humidity and temperature, moisture leakage through door gaskets and seals, and moisture emanation from the stored food load. The present control, however, assures that the defrosting operations are initiated only on an actual demand, or requirement basis.

The sensitivity of the gate 30g circuit of the control circuit portion 24 of thick film element 22 depends, to a large extent, upon the resistance value of gate-to-cathode resistor 34. When the resistance of resistor 34 is low, more current is required from the moisture responsive resistance element 26, or from the circuit resistor 41, to trigger the silicon controlled rectifier 30. Conversely, if the resistance of resistor 34 is high, gate 30*g* circuit is more sensitive and less current from resistor 26 or 41 is required to trigger the silicon controlled rectifier 30 and thereby energize the thermal relay heater 61.

Figure 6:
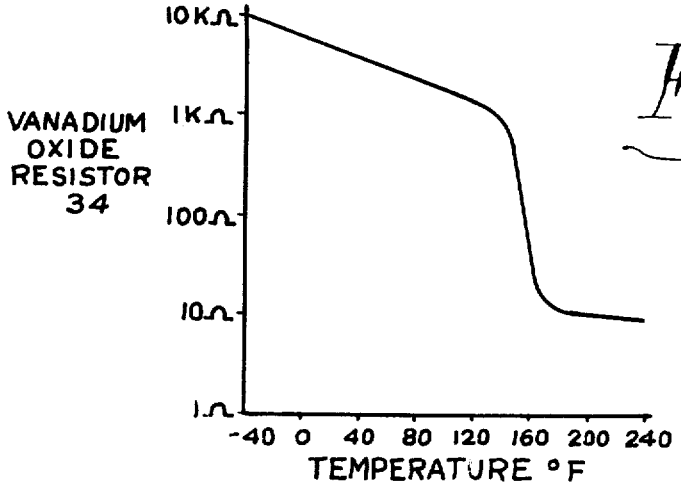
FIG. 6 is a graph showing the temperature-resistance characteristics of the vanadium oxide resistor thereof.

In the preferred embodiment of the present invention, resistor 34 comprises a thick film vanadium oxide resistance element with a negative temperature coefficient of resistance as illustrated in FIG. 6. A vanadium oxide thick film paste for such use is that marketed as "Tyox" by duPont. At normal operating temperatures of approximately 0°F., the gently sloping negative temperature coefficient of resistor 34 counteracts the negative temperature coefficient of resistance of the lithium chloride hygroscopic salt component of the hygroscopic film 48 portion of moisture responsive resistance element 26, thereby making the control circuit 24 substantially insensitive to temporary temperature transients such as may be caused by refrigerator or freezer door openings, or by the cycling of compressor motor 63 by the freezer thermostat 61.

As best seen in FIG. 6, at temperatures near 158°F, the resistance of the vanadium oxide resistor 34 decreases sharply. This characteristic provides herein a secondary, failsafe means of terminating the defrost period in the event that bimetal contact 21 fails in the closed position or the temperature setting of the bimetal thermostat 21 is too high. As shown in FIG. 5, resistor 34 is spaced sufficiently from heater resistors 25 and 41 so that the combined heat from resistors 25 and 41 and the main evaporator heater 19 will cause the temperature of resistor 34 to reach 158°F. within several minutes after bimetal contact 21 normally opens. When this happens, the resistance of resistor 34 is low enough to prevent sufficient current from resistor 41 from triggering the gate 30*g* of the silicon controlled rectifier 30 so that the defrost cycle will terminate after the thermal relay cools sufficiently to cause switch 60 to return to its normally closed position. Illustratively, the cool down period may be approximately 2 minutes. At 75°F., the resistance of resistor 34 may be approximately 2k ohms.

When the bimetal thermostat 21 is functioning in a normal manner, the approximately 2 minute cool down time required by the thermal relay 20 concurrently effectively times a water run-off period for eliminating frost which may have accumulated in the sump area beneath the evaporator by permitting it to melt and drain away. Such run-off period is not required when the bimetal 21 has failed to open as in the above discussed fail-safe mode, as all frost will have melted and drained away by the time such a defrost period is terminated.

In the exemplary control circuit, voltage is not applied across the moisture responsive resistor element 26 (1) while element 26 is being thermally regenerated during defrost periods, and (2) during the period immediately following each defrost cycle when the temperature of element 26 may still be high. Thus, except when the bimetal 21 has failed, voltage is only applied across the moisture responsive resistor element 26 when the element is relatively cold, thereby improving element life and minimizing maintenance. The voltage applied across element 26 is alternating current at 50 or 60 cycles per second with little or no direct current component, thereby minimizing the possibility of polarization of the electrodes 49, 50, 51, 52, 53, 54, and 55 of element 26.

The word "absorption," as used herein, characterizes both (1) the physical adsorption of water vapor on the large solid internal surfaces of the synthetic zeolite filter 27, and (2) the chemical-like absorption of water vapor by the hygroscopic film 48, As the synthetic zeolite has a 3 angstrom pore size, only water vapor and air may readily pass to the enclosed air space 29. The atmosphere in space 29 in contact with the hygroscopic film 48 is thereby kept relatively free of ammonia, hydrogen sulphide, and other larger molecules which may be present in the refrigerated air stream as contaminants.

During thermal regeneration, outer surface 56 of desiccant filter 27 desorbs water vapor and effectively carries away contaminants which may have accumulated on the outer surface 56 in the manner of steam cleaning.

The total mass of the water vapor accumulated by both the hygroscopic film 48 and the desiccant filter 27 during the interval between defrost periods may be less than approximately 1/30th of 1 gram, while the evaporator may accumulate in excess of 400 grams of frost. However, the rate of water vapor accumulation by the sensor/cumulator 23 is an effective analog of the rate of frost formation on the evaporator 16, as both rates are determined primarily by the temperature and humidity of the refrigerated air. As will be obvious to those skilled in the art, the invention comprehends different methods of modifying the performance of the demand defrost control 22 to optimize this analogy to achieve maximum efficiency of the refrigeration system. Illustratively, the interval between defrost periods may be shortened as by (1) increasing the lithium chloride/-binding agent ratio in the hygroscopic film formula, (2) decreasing the thickness of the desiccant filter 27, (3) increasing the cross-sectional area of the desiccant filter 27, (4) decreasing the spacing between interdigital conductors comprising the electrodes of the moisture responsive resistance element 26, (5) increasing either the number of interdigital fingers or the finger lengths, (6) decreasing the resistance of series connected resistors 35, 36, 37, 38, 39, and 40, (7) increasing the resistance of the gate to cathode resistor 34, (8) locating the sensor/cumulator element 23 in a warmer region of the refrigeration system 10, (9) increasing the rate of air flow in the vicinity of the outer surface 56 of the desiccant filter 27, (10) increasing the number of macropores or air channels within the desiccant filter 27, and/or (11) decreasing the wattage of the regeneration heater 25.

Conversely, the interval between defrost periods may be lengthened by varying any or all of the above parameters in the opposite manner except number (8) wherein the preferred location of the sensor/cumulator 23 is at or near the coldest portion of the refrigerated air stream.

Variations in performance may also be achieved by altering the thickness of the hygroscopic film 48, accompanied by a suitable variation in the lithium chloride/binding agent ratio so that (1) the control will eventually initiate a defrost period under the lowest usage and humidity conditions to which the refrigeration system might be subjected, and (2) the control will not initiate a continuous string of defrost periods under the highest usage and humidity conditions to which the refrigeration system might be subjected with the bimetal 21 failed in the closed position. It has been found to be advantageous to use a thin hygroscopic film 48 to avoid cracking or crazing of the film due to (1) thermal cycling or (2) the physical expansion of lithium chloride which occurs when moisture is absorbed. Too small a spacing between interdigital conductors has been found to cause discoloration of the film 48 due to excessive heating. When the hygroscopic salt/binding agent ratio is too high, the hygroscopic salt may creep or agglomerate, causing an irreversible, undesirable change in calibration of the moisture responsive resistance element 26.

The air flow rate in the vicinity of the outer surface 56 of the desiccant filter is preferably just fast enough to provide a continual freshening of the air over surface 56 when the fan 18 is operating but not so fast as to permit contaminants present in the refrigerated air to accumulate on surface 56.

The resistance of the gate-to-cathode resistor 34 must be small enough to prevent random noise triggering of silicon controlled rectifier 30. The series resistors 35, 36, 37, 38, 39 and 40 must be large enough to limit the power dissipation of the moisture response resistor element 26 to a safe low value under all normal long term operating conditions and also in the event of a water drop impingement on the desiccant filter 27. A baffle 63 may be attached above the thick film element 22 to prevent such drop impingements and control the air flow over the outer surface 56 of desiccant filter 27 to optimize the overall performance of the control.

The demand defrost control of the present invention provides an improved low cost moisture integrating means for effecting controlled operation of a refrigeration system as a function of accumulated moisture. The present control provides such improved functioning while yet comprising means extremely simple and economical of manufacture and yet requiring minimal maintenance.

The foregoing disclosure of specific embodiments is illustrative of the broad inventive concepts comprehended by the invention.

The embodiments of the invention in which an exclusive property or privilege is claimed are defined as follows:

1. Improved control means adapted to be responsive to humidity conditions of refrigerated air in a refrigeration system for controlling the operation of the refrigeration system defrost means, comprising: moisture sensing and accumulating means defining a variable electrical resistance varying as an inverse function of the amount of moisture absorbed thereby; means defining a closed chamber confronting said moisture sensing and accumulating means; circuit means responsive to said variable resistance including a thermal relay having a heater element and a switch for controlling the defrosting operation, and means responsive to said resistance reaching a preselected low resistance for actuating said heater element; and means providing controlled communication between said chamber and the refrigerated air including absorption means spaced from said moisture sensing and accumulating means for absorbing moisture from the refrigerated air for retarding transfer of moisture to said moisture sensing and accumulating means and thereby delaying the dropping of said resistance until a preselected total amount of moisture has been absorbed from said refrigerated air by said moisture sensing and accumulating means and said absorption means.

2. The control means of claim 1 wherein said responsive means comprises a controlled rectifier for activating said thermal relay heater element having a gate triggering circuit.

3. The control means of claim 1 wherein said responsive means comprises a sensitive gate silicon controlled rectifier for activating said thermal relay heater element having a gate triggering circuit.

4. The control means of claim 2 wherein said moisture sensing and accumulating means and said rectifier are carried on a ceramic thick film/hybrid microelectronic substrate.

5. The control means of claim 2 wherein said moisture sensing and accumulating means and said rectifier are carried on a ceramic thick film/hybrid microelectronic substrate and electrical conductor lead wires are attached to the substrate adjacent the controlled rectifier to define a heat sink.

6. The control means of claim 1 wherein the refrigeration system includes a cooling means and said thermal relay switch controls the operation of the cooling means to reactivate the cooling means a preselected period of time subsequent to a de-energization of the thermal relay heater element.

7. The control means of claim 2 wherein said moisture sensing and accumulating means, a thermal responsive resistor connected to the gate of the rectifier, and said rectifier are carried on a ceramic thick film/hybrid microelectronic substrate.

8. The control means of claim 7 wherein said thermal responsive resistor is spaced remotely from said moisture sensing and accumulating means.

9. The control means of claim 1 wherein the refrigeration system includes a cooling means and said thermal relay is spaced remotely from said cooling means.

10. The control means of claim 1 wherein the thermal relay is disposed in heat transfer association with said moisture sensing and accumulating means for removing absorbed moisture from the moisture sensing and accumulating means.

11. Improved control means adapted to be responsive to humidity conditions of refrigerated air in a refrigeration system for controlling the operation of the refrigeration system defrost means, comprising: moisture sensing and accumulating means defining a variable electrical resistance varying as an inverse function of the amount of moisture absorbed thereby; means defining a closed chamber confronting said moisture sensing and accumulating means; means providing controlled communication between said chamber and the refrigerated air including absorption means spaced from said moisture sensing and accumulating means for absorbing moisture from the refrigerated air for retarding transfer of moisture to said moisture sensing and accumulating means and thereby delaying the dropping of said resistance until a preselected total amount of moisture has been absorbed from said refrigerated air by said moisture sensing and accumulating means and said absorption means; regeneration means for selectively removing absorbed moisture from said moisture sensing and accumulating means; a ceramic substrate element carrying said moisture sensing and accumulating means; and a thermal response control for controlling the length of a defrost cycle comprising a bimetal thermostat which opens when the temperature sensed thereby rises to a preselected temperatures.

12. Improved control means adapted to be responsive to humidity conditions of refrigerated air in a refrigeration system for controlling the operation of the refrigeration system defrost means, comprising: moisture sensing and accumulating means defining a variable electrical resistance varying as an inverse function of the amount of moisture absorbed thereby; means defining a closed chamber confronting said moisture sensing and accumulating means; means providing controlled communication between said chamber and the refrigerated air including absorption means spaced from said moisture sensing and accumulating means for absorbing moisture from the refrigerated air for retarding transfer of moisture to said moisture sensing and accumulating means and thereby delaying the dropping of said resistance until a preselected total amount of moisture has been absorbed from said refrigerated air by said moisture sensing and accumulating means and said absorption means; regeneration means for selectively removing absorbed moisture from said moisture sensing and accumulating means; a ceramic substrate element; and a thermal responsive control carried on said substrate element for controlling the length of a defrost cycle comprising a gated rectifier and a thermal responsive resistor connected to the gate of the rectifier for permitting firing of the gated rectifier only when the resistor is below a preselected temperature.

13. Improved control means adapted to be responsive to humidity conditions of refrigerated air in a refrigeration system for controlling the operation of the refrigeration system defrost means, comprising: moisture sensing and accumulating means defining a variable electrical resistance varying as an inverse function of the amount of moisture absorbed thereby; means defining a closed chamber confronting said moisture sensing and accumulating means; means providing controlled communication between said chamber and the refrigerated air including absorption means spaced from said moisture sensing and accumulating means for absorbing moisture from the refrigerated air for retarding transfer of moisture to said moisture sensing and accumulating means and thereby delaying the dropping of said resistance until a preselected total amount of moisture has been absorbed from said refrigerated air by said moisture sensing and accumulating means and said absorption means; and regeneration means for selectively removing absorbed moisture from said moisture sensing and accumulating means, said refrigeration system including an evaporator, said control including an evaporator bimetal thermostat arranged to prevent activation of the defrost means when said bimetal is in an open circuit, high temperature position thereby avoiding an immediate defrost cycle which might otherwise occur when said refrigeration system is installed or when said refrigeration system is reactivated after a period of discontinued usage and spurious defrost cycles which may occur as a result of temporary cool down transients in said resistance following thermal regeneration of said element.

14. Improved control means adapted to be responsive to humidity conditions of refrigerated air in a refrigeration system for controlling the operation of the refrigeration system defrost means, comprising: moisture sensing and accumulating means defining a variable electrical resistance varying as an inverse function of the amount of moisture absorbed thereby; means defining a closed chamber confronting said moisture sensing and accumulating means; means providing controlled communication between said chamber and the refrigerated air including absorption means spaced from said moisture sensing and accumulating means for absorbing moisture from the refrigerated air for retarding transfer of moisture to said moisture sensing and accumulating means and thereby delaying the dropping of said resistance until a preselected total amount of moisture has been absorbed from said refrigerated air by said moisture sensing and accumulating means and said absorption means; and regeneration means for selectively removing absorbed moisture from said moisture sensing and accumulating means, said defrost means providing heat to said moisture sensing and accumulating means during a defrosting cycle for removing absorbed moisture from the moisture sensing and accumulating means.

15. In a refrigerated system having cooling means, air moving means for flowing air in heat exchange relationship with the cooling means, and defrosting means for defrosting the cooling means, means for controlling the operation of the defrosting means comprising: moisture accumulating means for accumulating moisture from the refrigerated air at a rate proportional to the relative humidity of the refrigerated air; means in moisture-receiving spaced relationship to said accumulating means and defining an electrical resistance varying inversely as the amount of moisture delivered thereto by said moisture accumulating means, said moisture accumulating means retarding transfer of moisture to said resistance means; control circuit means responsive to said resistance reaching a preselected low value as the result of the delayed transfer of moisture from said moisture accumulating means to initiate operation of the defrosting means; regeneration means for removing moisture from said moisture accumulating means subsequent to initiation of operation of the defrosting means; and control means for terminating operation of the defrosting means.

16. The refrigeration system of claim 15 wherein said moisture accumulating means comprises a filter.

17. The refrigeration system of claim 15 wherein said moisture accumulating means comprises a filter formed of desiccant material.

18. The refrigeration system of claim 15 wherein said regeneration means is arranged to remove moisture from said moisture accumulating means during the operation of the defrosting means.

19. In a refrigeration system having cooling means and first heating means for defrosting the cooling means, means for controlling the operation of the defrosting means comprising: means for absorbing atmospheric moisture and defining an electrical resistance inversely proportional to the amount of absorbed moisture; control means responsive to said resistance reaching a preselected low value to initiate operation of the defrosting means; second heating means separate from said first heating means for removing moisture from the moisture absorbing means for regeneration thereof; and means responsive to said cooling means reaching a preselected high temperature as a result of the defrosting operation to terminate energization of said first heating means to terminate the defrosting operation, said high temperature responsive means further controlling operation of said moisture removing second heating means.

20. The refrigeration system means of claim 19 wherein said high temperature responsive means causes initiation of operation of the moisture removing means upon said cooling means reaching a preselected high temperature.

21. The refrigeration system means of claim 19 wherein said high temperature responsive means causes initiation of operation of the moisture removing means upon said cooling means reaching said preselected high temperature.

22. The refrigeration system means of claim 19 wherein said moisture absorbing means is disposed adjacent said high temperature responsive means.

23. The refrigeration system means of claim 19 wherein said control means includes an electronic switch having a gate and said resistance controls the current delivered to said gate.

24. The refrigeration system means of claim 19 wherein said moisture absorbing means is disposed adjacent said cooling means.

25. The refrigeration system means of claim 19 further including means for preventing momentary temperature increases adjacent the moisture absorbing means for initiation operation of the defrosting means.

26. The refrigeration system means of claim 19 wherein said control means includes means for limiting current flow through said moisture absorbing means to preclude damage to the moisture absorbing means in the event liquid in drop form impinges thereon.

27. The refrigeration system means of claim 19 wherein said moisture absorbing means is disposed adjacent the defrosting means to permit regeneration of the moisture absorbing means by the defrosting means.

28. The refrigeration system means of claim 19 wherein said moisture removing means comprises means for heating said moisture absorbing means.

29. The refrigeration system means of claim 19 wherein said control means includes means for causing operation of the moisture removing means each operation of the defrosting means.

30. In a refrigeration system having cooling means and defrosting means for defrosting the cooling means, means for controlling the operation of the defrosting means comprising: first selector control means for selectively alternatively energizing the cooling means and energizing the defrosting means; operating means for disposing said first control means to energize the defrosting means; second control means for permitting energization of the defrosting means and disposing of said operating means to energize the defrosting means only when the temperature of the cooling means is below a preselected low temperature; controlled switch means permitting operation of said operating means to dispose said first control means to energize the defrosting means only when said controlled switch means is switched on; means for switching said controlled switch means on when said first control means is arranged to energize said cooling means and need for initiating a defrosting operation is indicated; and means for preventing said controlled switch means from being switched on for more than a preselected maximum time when said first and second control means are arranged to effect energizing of the defrosting means.

31. The means for controlling the operation of a refrigeration system defrosting means of claim 30 wherein said operating means comprises time delay means maintaining said first control means disposed to energize the defrosting means for a preselected period of time after operation of said operating means by said controlled switch means is terminated.

32. The means for controlling the operation of a refrigeration system defrosting means of claim 33 wherein said means for switching said controlled switch on comprises means responsive to accumulation of a preselected amount of moisture from said refrigeration system for switching said controlled switch on.

33. In a refrigeration system having cooling means and defrosting means for defrosting the cooling means, means for controlling the operation of the defrosting means comprising: a selector control switch selectively disposable in a first, normal position for energizing the cooling means, and in a second, thrown position for energizing the defrosting means; operating means for throwing said control switch to said second position; a thermostat switch responsive to the temperature of the cooling means connected to permit energization of the defrosting means and operation of said operating means to throw said control switch to said second position only when said temperature is below a preselected low temperature; a gated electronic switch connected between said thermostat switch and said operating means permitting actuation of said operating means only when said gated switch is gated on; defrostneed responsive means gating said gated switch on when said control switch is in said first position and need for initiating a defrost operation is sensed; and means for preventing gating of said gated switch on for more than a preselected maximum time when said control switch is thrown to said second position and said thermostat switch is arranged to permit energization of the defrosting means.

34. The means for controlling the operation of a refrigeration system defrosting means of claim 33 wherein said control switch operating means comprises time delay means maintaining said control switch in said second position for a preselected period of time after actuation of said operating means is terminated.

35. The means for controlling the operation of a refrigeration system defrosting means of claim 33 wherein said control switch comprises a thermally responsive switch and said operating means comprises a heater.

36. The means for controlling the operation of a refrigeration system defrosting means of claim 33 wherein said defrost-need responsive means comprises means responsive to accumulation of a preselected amount of moisture from said refrigeration system for gating said gated switch on.

37. The means for controlling the operation of a refrigeration system defrosting means of claim 33 wherein said defrost-need responsive means comprises means defining a resistance varying inversely as a function of moisture accumulated from said refrigeration system and electrically associated with said gated switch to gate said switch on when the resistance thereof reaches a preselected low value.

38. The means for controlling the operation of a refrigeration system defrosting means of claim 33 wherein said defrost-need responsive means comprises means defining a resistance varying inversely as a function of moisture accumulated from said refrigeration system and electrically associated with said gated switch to gate said switch on when the resistance thereof reaches a preselected low value, and said defrosting operation controlling means further includes means for removing accumulated moisture from said defrost-need responsive means during the operation of the defrosting means to restore the resistance means to a high resistance value above said preselected low value.

39. The means for controlling the operation of a refrigeration system defrosting means of claim 33 wherein aid defrosting means comprises heating means, and said means maintaining gating of said gated switch includes thermally responsive means permitting gating of the gated switch only when the temperature of the thermally responsive means is below a preselected temperature, said thermally responsive means being in heat exchange relationship with said defrosting heating means so as to prevent gating of the gated switch as the result of a continuation of the defrosting operation beyond a preselected maximum period of time.

40. The means for controlling the operation of a refrigeration system defrosting means of claim 33 wherein said means maintaining gating of said gated switch includes thermally responsive means permiting gating of the gated switch only when the temperature of the thermally responsive means is below a preselected temperature, said defrosting controlling means includes means for regenerating the defrost-need responsive means subsequent to initiation of a defrosting operation, said regenerating means including heater means for heating the defrost-need responsive means during the defrosting operation and said thermally responsive means being in heat exchange relationship with said heater means so as to prevent gating of the gated switch as the result of a continuation of the defrosting operation beyond a preselected maximum period of time.

* * * * *